United States Patent [19]

Orain

[11] 4,430,873

[45] Feb. 14, 1984

[54] APPARATUS FOR FORMING GROOVES HAVING A CURVED AXIS AND A CIRCULAR CROSS-SECTIONAL SHAPE

[75] Inventor: Michel A. Orain, Conflans Ste Honorine, France

[73] Assignee: Glaenzer Spicer, Poissy, France

[21] Appl. No.: 335,660

[22] Filed: Dec. 30, 1981

[30] Foreign Application Priority Data

Jan. 21, 1981 [FR] France ..... 81 01027

[51] Int. Cl.[3] ..... B21D 17/04; B21J 5/12

[52] U.S. Cl. ..... 72/75; 72/215; 72/125; 72/406

[58] Field of Search ..... 72/75, 115, 125, 215, 72/406

[56] References Cited

U.S. PATENT DOCUMENTS 3,457,750 7/1969 Orain ..... 72/75

3,974,677 8/1976 Castellani ..... 72/377

FOREIGN PATENT DOCUMENTS 157702 2/1957 Sweden ..... 72/75

*Primary Examiner*—Lowell A. Larson

*Attorney, Agent, or Firm*—Wenderoth, Lind & Ponack

[57] ABSTRACT

The apparatus comprises a support for supporting a blank in which at least one groove having a curved axis and a circular section is to be formed, a ball for forming the groove and carried at one end of a ball holder, a device for displacing the ball holder, and an articulated quadrilateral structure which has a first side rigid with the support and a second side in which the ball holder is fixed by an end of the ball holder. The second side is opposed to the first side of the quadrilateral structure. Thus the ball holder is movable relative to the support by the ball holder displacing device. An application of the apparatus is in the forming of runways in transmission joints of the tripod type.

10 Claims, 3 Drawing Figures

APPARATUS FOR FORMING GROOVES HAVING A CURVED AXIS AND A CIRCULAR CROSS-SECTIONAL SHAPE

The present invention relates to an apparatus for forming a groove having a curved axis and a circular cross-sectional shape in a blank, of the type comprising a support adapted to hold the blank, a ball holder carrying at one end a ball which laterally projects, and means for displacing the ball holder.

The invention particularly concerns the production of part-torus runways in the tulip elements of transmission joints of the tripod type.

The slidable tripod type joints provided on lateral transmission shafts of front wheel drive vehicles comprise a tulip element which has three pairs of runways having a circular cross-sectional shape along which roll three externally spherical rollers carried by the tripod element of the joint.

When the mean operating angle of these joints is large, it is advantageous, for the purpose of reducing cyclic variations in the friction, to replace the conventional runways having rectilinear axes parallel to the axis of rotation by part-torus runways whose centre line or axis is a circumference which has a radius of the order of twice the distance from the centre of the rollers to the axis of rotation in the straight position of the joint, ie. when the two parts of the joint are in axial alignment with each other.

Likewise, tripod type joints which are axially fixed and allow a large break angle for driving the steering and driving wheels, permit a larger angularity when they have part-torus runways which are either centered on the axis of rotation or have a larger radius.

Now, the production of these part-torus runways gives rise to difficulties when it is desired to produce them cheaply on an industrial scale. Indeed, a good surface condition must be obtained and a perfect concentricity must be achieved between the two confronting circular section runways and the cheap cold-forming apparatus which may be used for conventional tripod type joints having rectilinear runways are not applicable.

The Applicant has already proposed (French Patent No. 1 477 521) an apparatus of the type mentioned above whereby it is possible to form grooves having a curved axis. However, in this known arrangement, the balls are guided by surfaces of high hardness which results in a rapid wear thereof and the precision of the forming operation is not fully satisfactory.

An object of the invention is to provide an apparatus for forming these part-torus runways, and more generally grooves having a curved axis and a circular section, which permits a simple and cheap production under cold conditions and at a high rate of such grooves which have an improved surface condition, with a reduced wear of the balls.

The invention therefore provides an apparatus for forming a groove having a curved axis and a circular section in a blank, of the aforementioned type, said apparatus comprising a quadrilateral articulated structure having one side rigid with the support, the ball holder being fixed by the end thereof opposed to the ball to the side of the quadrilateral structure opposed to the support.

In a particular embodiment, for simultaneously forming a plurality of curved longitudinal grooves in a blank of a workpiece having a symmetry of revolution, and in particular a blank of a tulip element of a tripod type joint, the support comprises a shoulder for axially supporting the blank and a sleeve surrounding the blank, and there are provided as many articulated quadrilateral structures as there are grooves to be produced, said quadrilateral structures being arranged along the circumference of the support, and means are provided for simultaneously displacing all the ball holders.

The invention will be described hereinafter in more detail with reference to the accompanying drawings which show merely one embodiment. In the drawings.

Figure 1:
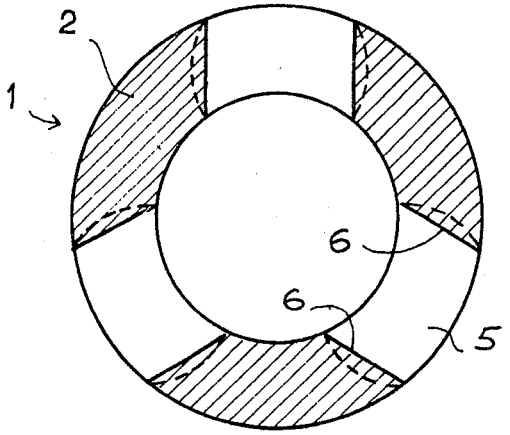
FIG. 1 is a cross-sectional view of a blank of a tulip element of a tripod type joint which is intended to be treated in accordance with the invention.

In the embodiment shown in the drawings, the invention is applied to the production of a tulip element of a tripod type transmission joint.

Figure 3:
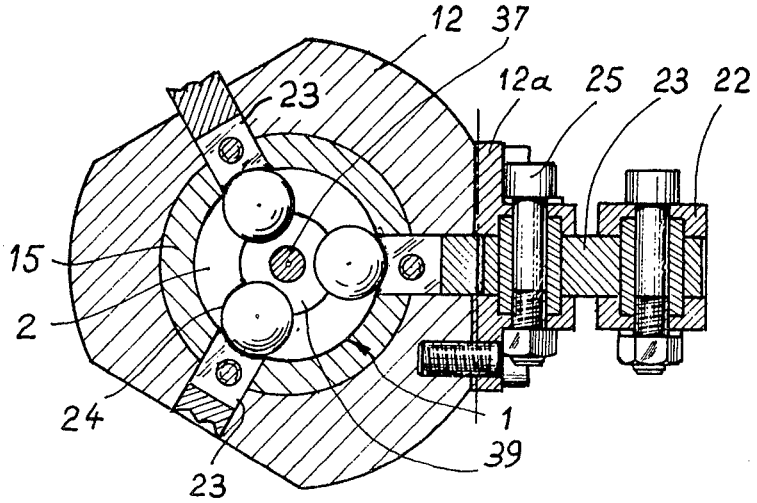
FIG. 3 is a partial cross-sectional view of the apparatus shown in FIG. 2, taken along line 3—3 of FIG. 2.
Figure 2:
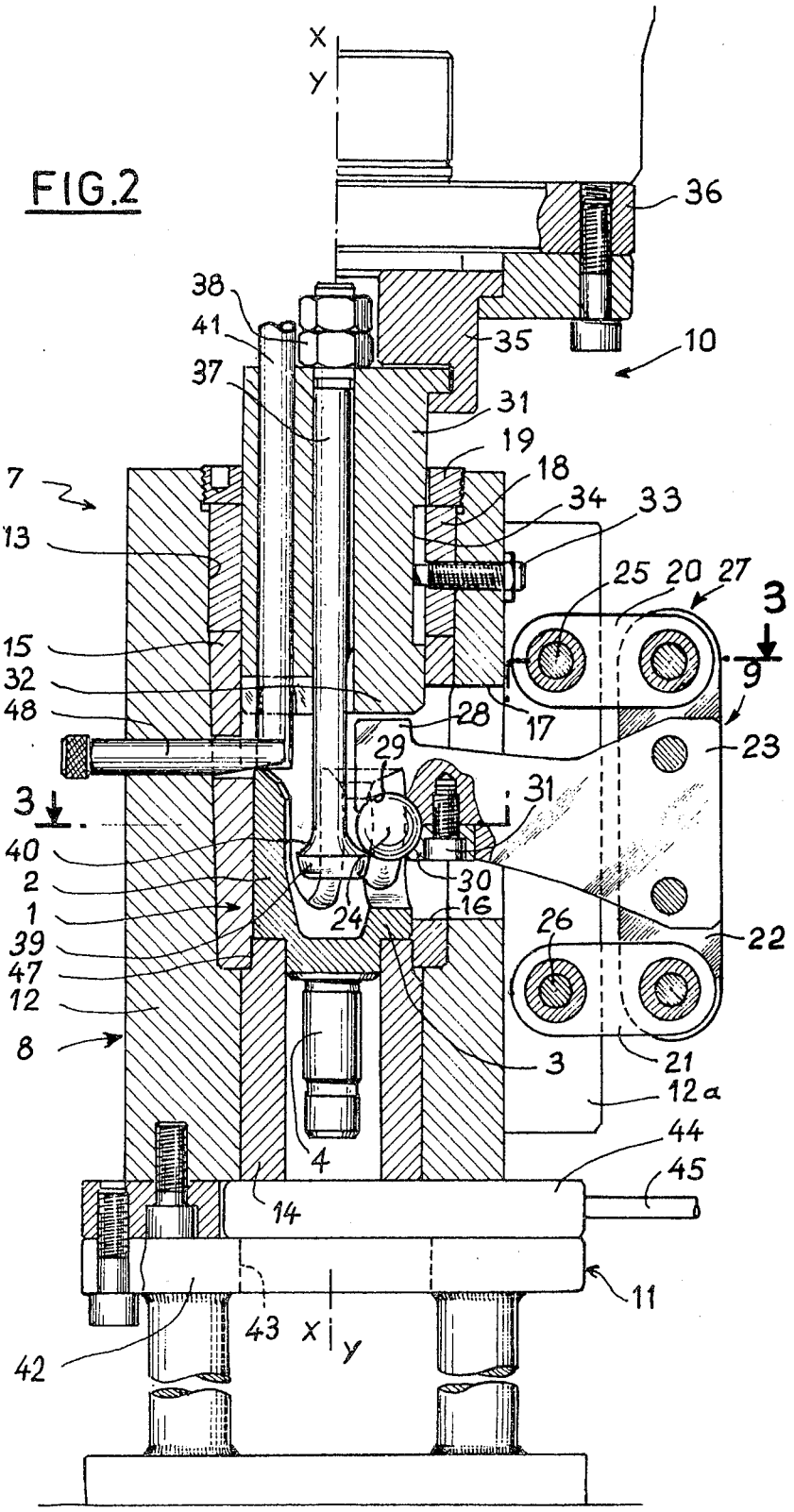
FIG. 2 is a longitudinal sectional view of an apparatus for forming said tulip element in accordance with the invention.

The apparatus shown in FIGS. 2 and 3 is adapted to form three part-torus grooves which define three pairs of runways in a blank 1 of the tulip element of a tripod type homokinetic joint shown in FIGS. 1 and 2.

The blank 1 comprises a tubular cylindrical body 2 open at only one end and having a bottom 3 which carries externally an axial stem 4 for fixing the tulip element to a rotary shaft. The body 2 has, extending from its open end, three longitudinal cavities 5 disposed at 120° to each other and defined by pairs of confronting planar surfaces 6 which are parallel to each other and to the axis X—X of the body. The cavities 5 extends down to the vicinity of the bottom 3.

With reference to FIGS. 2 and 3, the apparatus 7 for forming the part-torus grooves mainly comprises a support 8, three ball devices 9 and a thrust device 10.

The support 8 comprises a stand 11 fixed to the ground and on which a very rigid sleeve 12 is secured. This sleeve has in the upper part thereof a counterbore 13 and acts as a cavity for receiving a cylindrical collar 14 without clearance. Fitted without clearance in the couunter-bore 13 is a sleeve 15 provided with three longitudinal slots 16 which are angularly spaced 120° apart and coincide in width and in length with three longitudinal slots 17 formed in the outer sleeve 12. The sleever 15 is maintained in position by an upper ring 18 which is held in position by a screwthreaded ring 19 screwthreadedly engaged in the upper opening of the counterbore 13. The sleeve 15 has an inside diameter equal to the outside diameter of the blank 1, this diameter being between the inner and outer diameters of the collar 14.

Each ball device 9 comprises a ball holder 23, a ball 24 and three links 20, 21, 22 of an articulated quadrilateral structure. The links 20 and 21 are identical and freely pivotally mounted by one end on respective pins 25, 26 which are superimposed, located at the same distance from the axis Y—Y of the sleeve 15 and carried by a base **12*a* which is fixed to an outer flat surface on the sleeve 12 and constitutes the fourth link of the articulated quadrilateral structure and is opposed to the link 22. The link 22 is pivotally mounted on the free ends of the links 20 and 21 and thus forms a movable vertical side of an articulated parallelogram structure 27**.

The ball holder 23 is a vertical plate of elongated shape in the horizontal direction which is secured by its outer end to the middle of the link 22, the other end thereof having an upwardly extending heel portion 28 which has a horizontal upper face, and a downwardly open spherical cavity 29. A retaining member 30 is secured to the ball holder 23 by a screw 31 so as to extend the cavity 29 and permit the retention of the ball 24 while allowing the latter to rotate about itself. The intermediate portion of the ball holder 23 extends through the slots 16 and 17 of the sleeve 15 and the sleeve 12, which slots guide this portion in vertical translation. Further, these slots have the same width as the cavities 5 of the blank 1 and the diameter of the ball 24 is greater than this dimension.

The thrust device 10 comprises a piston 31 which slides in the ring 18 and the sleeve 15 and has, at the lower end thereof, three axial projections 32 which have a horizontal lower surface, each projection being in the radial plane of a pair of slots 16–17. The piston 31 is guided in translation by a screw 33 which radially extends through the sleeve 12 and the ring 18 and is engaged in a longitudinal slot 34 in the piston.

The upper end of the piston 31 is connected by an adapter 35 to a press plate 36. An axial rod 37 is slidably mounted in a centre bore in the piston 31 and retained by nuts 38 engaged on the upper end portion of the rod and has, in a position distinctly below the projections 32 of the piston, an enlarged lower end portion 39. The latter is connected to the rest of the rod 37 by a concave surface 40 having a rounded profile.

Three identical ejecting rods 41 extend through eccentric longitudinal bores in the piston 31 in radial semi-planes opposed to the slots 16 and 17 with respect to the axis Y—Y. The upper end of the three rods 41 is connected to a piston (not shown) incorporated in the press plate 36.

In order to form under cold conditions three part-torus grooves in the blank 1, the latter is placed, with the upper end uppermost, on the upper end of the collar 14 outside the apparatus 7. This is possible, since the stand 11 includes a lower plate 42 provided with a centre aperture 43 having the same diameter as the outside diameter of the collar 14 and an unperforated upper plate 44 horizontally slidable under the action of a lateral rod 45.

With the plate 36 raised and the rods 41 upwardly withdrawn, the assembly comprising the blank 1 and the collar 14 is inserted through the aperture 43 and the plate 44 is put back into position so as to act as a support therefor. The body 2 is then fitted without clearance in the sleeve 15, the lower end portion of which sleeve is fitted in a recess 47 in the collar 14. The assembly comprising the blank and the collar 14 is held in position axially by a pin 48 which extends radially through the sleeve 12 and the sleeve 15 and which has a chamfered head portion which engages the upper end surface of the blank 1. In placing itself in position, the latter has urged three balls 24 upwardly and these balls bear freely against the entrance of the cavities 5. Any suitable means may be provided for ensuring the correct angular positioning of the blank 1, ie. the exact correspondence of the cavities 5 with the slots 16 and 17 of the apparatus 7.

With the rods 41 remaining withdrawn into the piston 31, the plate 36 is lowered. The projections 32 of the piston 31 come into contact with the heel portions 28 of the ball holders 23 and urge them downwardly and this forces the balls 24 into the cavities 5, the balls travelling along the path defined by the deformation of the articulated parallelogram structure 27. The centre of each ball 24 thus describes an arc of a circle contained in a radial plane, the radius of which circle is equal to the distance between the pivot pins of the links 20 and 21. In this way, the desired three part-torus grooves are formed.

During this stage of operation, the central rod 37 is suspended from the piston 31 by the nuts 38 and its concave surface 40 is located slightly below the balls 24. When the plate 36 arrives at the end of the downward travel, the balls 24 having formed the circular section grooves substantially to the lower end of the cavities 5, this plate is raised. The blank 1 is retained by the pins 48 and the surface 40 of the rod 37 engages the lower region of the three balls 34 and raises the latter. As they are guided in the same way by the articulated parallelogram structure, the balls 24 travel through the same paths in the opposite direction and effect a finishing operation on the three part-torus grooves.

The plate 44 is then withdrawn horizontally and the rods 41 are extended so that the latter engage the upper end face of the finished tulip element and eject it downwardly at the same time as the collar 14.

Owing the fact that the balls 24 are free to rotate, the latter are worn uniformly and have a very long life. Further, the frictions are automatically balanced in the course of the forming operation. After wear, the balls may be replaced or reconditioned with a coating of an anti-wear surface such as a phosphatization with impregnation with molybdenum bisulphite according to a known technique.

The radius of the tori of the grooves may be adjusted merely by the choice of the distance between the pivot pins of the links 20 and 21. In particular, part-torus grooves may be formed with a centre which is located in the vicinity of the axis of rotation Y—Y of the tulip element, which corresponds to the case of "fixed" homokinetic joints having a large break angle.

Note that if the body of the blank does not have a cylindrical outer shape, it is desirable to modify this outer shape, for example by means of three planes parallel to the axis X—X, so as to enable the blank to be placed in position and ejected by a simple axial displacement without requiring an openable support device 8. This is in particular the case of the tulip elements of fixed tripod type joints which usually have a spherical outer shape. The blank is then maintained circumferentially by a sleeve having a complementary shape which has for function, in the same way as the sleeve 15, to prevent the radial swelling or expansion of the body of the blank during the forming operation.

By way of a modification, any number of part-torus grooves may be formed simultaneously by an obvious adaptation of the apparatus 7. Further, if different lengths are given to the links 20 and 21 or if there is a defect in the parallelism in each device 9, part-torus grooves may be formed whose axis is curved and has any desired shape other than that of a torus.

Having now described my invention what I claim as new and desire to secure by Letters Patent is:

1. An apparatus for forming a groove having a curved axis and a circular section in a blank, said apparatus comprising a support adapted to maintain the blank in position, a ball holder, a ball which is carried at one end of the ball holder and laterally projects from the ball holder, means for displacing the ball holder, an articulated quadrilateral structure which has a first side link rigid with said support, a second side link opposed to said first side link and two opposed side links respectively and freely pivotally articulated to and interconnecting said first side link and said second side link, the ball holder being fixed by an end thereof opposed said one end to said second side link whereby the ball holder is movable relative to said support by relative mobility of said first and second side links.

2. An apparatus according to claim 1, wherein the ball holder extends substantially in a direction perpendicular to said second side link of the quadrilateral structure.

3. An apparatus according to claim 1, wherein the ball holder displacing means is operative on an end portion of the ball holder which end portion is adjacent to the ball.

4. An apparatus according to claim 1, wherein the ball holder displacing means is operative to displace the ball holder in opposite directions.

5. An apparatus according to claim 4, wherein the ball holder displacing means has an operative travel and an inoperative travel in said opposite directions.

6. An apparatus according to claim 1, wherein the ball is rotatively mounted in a spherical cavity in the ball holder.

7. An apparatus according to any one of the claims 1 to 6, wherein the ball is detachably mounted in the ball holder.

8. An apparatus according to any one of the claims 1 to 6, wherein the quadrilateral structure is a parallelogram structure.

9. An apparatus according to any one of the claims 1 to 6, wherein the ball holder has the same width as a cavity in the blank in which the groove having a curved axis must be formed, said cavity in the blank having planar walls.

10. An apparatus according to any one of the claims 1 to 6, for simultaneously forming a plurality of said grooves extending longitudinally in a blank of a workpiece having a symmetry of revolution, in particular a tulip element of a tripod type joint, said support comprising a shoulder for axially supporting the blank and a sleeve surrounding said blank, there being provided as many of said quadrilateral structure as there are grooves to be formed, said quadrilateral structures being arranged around the circumference of the support and said ball holder displacing means being operative to displace simultaneously all the ball holders.

* * * * *